United States Patent [19]

Raftery

[11] Patent Number: 4,498,702

[45] Date of Patent: Feb. 12, 1985

[54] SEATING UNIT WITH FRONT FLEX AREA

[75] Inventor: William B. Raftery, Arlington, Tex.

[73] Assignee: Steelcase Inc., Grand Rapids, Mich.

[21] Appl. No.: 387,415

[22] Filed: Jun. 11, 1982

[51] Int. Cl.[3] ..... A47C 1/034

[52] U.S. Cl. ..... 297/312; 297/429; 297/433; 297/458

[58] Field of Search ..... 297/312, 344, 201, 429, 297/433, 458, 304, 300

[56] References Cited

U.S. PATENT DOCUMENTS

| | | | |
|---|---|---|---|
| 3,057,660 | 10/1962 | Schneider | 297/312 |
| 3,446,532 | 5/1969 | Cramer | 297/312 |
| 3,632,166 | 1/1972 | Lohr | 297/344 X |
| 3,851,920 | 12/1974 | Harris | 297/458 X |
| 3,881,772 | 5/1975 | Mohrman | 297/300 |
| 3,883,173 | 5/1975 | Shephard et al. | 297/312 |
| 4,380,352 | 4/1983 | Diffrient | 297/312 X |

*Primary Examiner*—William E. Lyddane
*Assistant Examiner*—Peter R. Brown
*Attorney, Agent, or Firm*—Price, Heneveld, Huizenga and Cooper

[57] ABSTRACT

A seating unit including a concavely curved seat element and a concavely curved thigh support flexibly connected by leaf springs, a stop bracket to define a gap therebetween, having a stop bracket and tabs on the thigh support to reduce the gap at the sides of the seating unit, and having arms which mask the gap at the sides of the seating unit. The thigh support resiliently and resistively deflects downward to a point at which it contacts the stop bracket, and the leaf springs lie parallel in the same plane so that the ends of the leaf springs do not separate as the thigh support is deflected.

44 Claims, 9 Drawing Figures

SEATING UNIT WITH FRONT FLEX AREA

BACKGROUND OF THE INVENTION

Seating units having various configurations and adjustments have been known in the art for many years. The breadth and variety of adjustable features on seating units are due to the desirability of furnishing a chair or seating unit which is adaptable to both a large number of people and which is also adaptable to a large number of seating positions for each individual user. These adjustments are used to provide maximum comfort in a seating unit.

It is particularly desirable to provide maximum comfort in office seating since a user must sit in such chairs for long periods of time and also since the user must be able to concentrate on their work without being distracted by uncomfortable seating. One desirable adjustment for a chair is the incorporation of a flexible area in the seat front edge upon which a user's thighs rest. This is particularly desirable in chairs having a tilting seat, so that as the user leans back in the chair thereby tilting the seat, the leading edge of the seat is depressed downward to allow the user's feet to remain on the floor.

Many different devices are known in the art for allowing the front portion of the seat to be depressed in the above manner. However, many of these devices require that the front thigh support area be manually adjusted and set at a particular position, thus remaining in that position until the seat is manually re-adjusted. Such devices are very adequate for some applications, but in other applications it is desirable that a user not be required to constantly adjust the front thigh support area. In such applications, the thigh support area should adapt itself constantly to the user's particular position.

Some chair front thigh support adjustment devices adjust automatically, but make use of complicated mechanisms. For example, most employ some type of linkage from the front of the chair seat to a stationary portion of the chair support. Such complicated mechanisms are costly to manufacture and assemble, and in addition, bulky and complicated adjustment devices are difficult to conceal internally to the seating unit. These bulky adjustment devices present an unsightly appearance to the overall design. An example of such unsightly features is the inclusion of a large knob for manual adjustment of the seat front portion, such knob being required to be exposed to perform its function. With the increased emphasis upon the visual appeal of office furniture, it is highly desirable that chair controls be maintained internally to the seating unit itself. It is therefore highly desirable that a front thigh support adjustment be simple in design so as to reduce the costs of the chair but maintain the desired adaptability to various uses and overall visual appeal.

SUMMARY OF THE INVENTION

The seating unit of the present invention includes a seat element for supporting a person during use of the unit, and a thigh support located in the front of the seat element so as to contact the thigh area of the user, wherein the thigh support is downwardly flexible under the pressure of the user's legs. Leaf spring means flexibly and resiliently connect the seat element and the thigh support in order to allow the thigh support to be deflected downward under the weight of a user's legs. The leaf spring means is sufficiently stiff to allow the thigh support to partially support the weight of a user's legs without having to use separate locking means to lock the thigh support portion in position.

Since the seating unit has a front flex portion joined thereto by a leaf spring means, the seating unit constantly adjusts to the seating position of the user without manual operation of a chair control. Since the front flex device is simple in design, it is inexpensive to manufacture and assemble, and is also easily concealable within the seating unit. Additionally, the area of transition between the seat and the thigh support does not present a sharp lid which would be uncomfortable for a user, even in seating having a curved seat portion so as to provide a comfortable shape.

DETAILED DESCRIPTION OF THE PREFERRED EMBODIMENT

Figure 1:
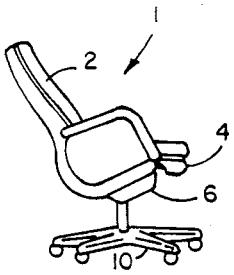
FIG. 1 is a side elevational view of a chair embodying the present invention in a tilted back position.
Figure 2:
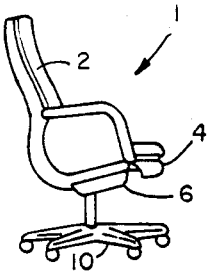
FIG. 2 is a side elevational view of the chair of FIG. 1 in an upright position.

The preferred embodiment chair 1 (FIGS. 1, 2, and 3) includes a chair body 2 mounted on a base 10, via chair control 6, with body 2 including a front thigh support 4. Thigh support 4 is joined to chair body 2 by resilient flexible leaf springs 50 (FIG. 3) which allow thigh support 4 to flex downwardly under the weight of the lower portions of a person's thighs, particularly as a person leans back in chair 1 (compare FIGS. 1 and 2; FIG. 1 assuming a person seated in chair 1, since if the chair were in fact empty, thigh support 4 would not tilt downwardly as shown in FIG. 1). Stop 100 (FIG. 3) is provided to limit the extent of downward tilting of thigh support 4.

Leaf springs 50 must be flexible and resilient such that as a person tilts rearwardly in chair 1, the weight of the front portion of his thighs and the appended lower portions of his legs cause the front thigh support area 4 to tilt downwardly. This helps the user keep his feet on the floor even as he tilts rearwardly in chair 1.

Yet, leaf springs 50 must be sufficiently stiff that they cause thigh support 4 to provide support for the user's lower thigh portions as he sits in chair 1. It is also preferable that leaf springs 50 be sufficiently long that they allow one to maintain a gap, at least internally, between front thigh support 4 and chair body 2.

The specific parameters needed to achieve these desirable functional results will vary from chair to chair, depending on other design factors involved in creating a particular chair. However, in the preferred embodiment chair, it has been found that the desirable results can be achieved using two straps, each 0.090 inches thick, $1\frac{1}{4}$ inches wide and approximately 5 inches long. Glass reinforced epoxy composite having a flexural strength of 167,000 psi has been found satisfactory. It is probable that other spring materials could be utilized, though the dimensions would probably have to be altered.

Figure 5:
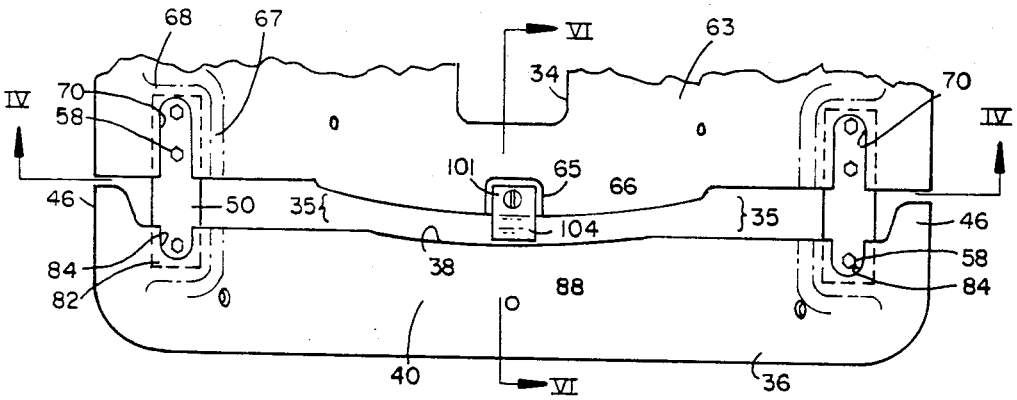
FIG. 5 is a fragmentary, top plan view of a front flex portion of a chair inner shell of the present invention.
Figure 6:
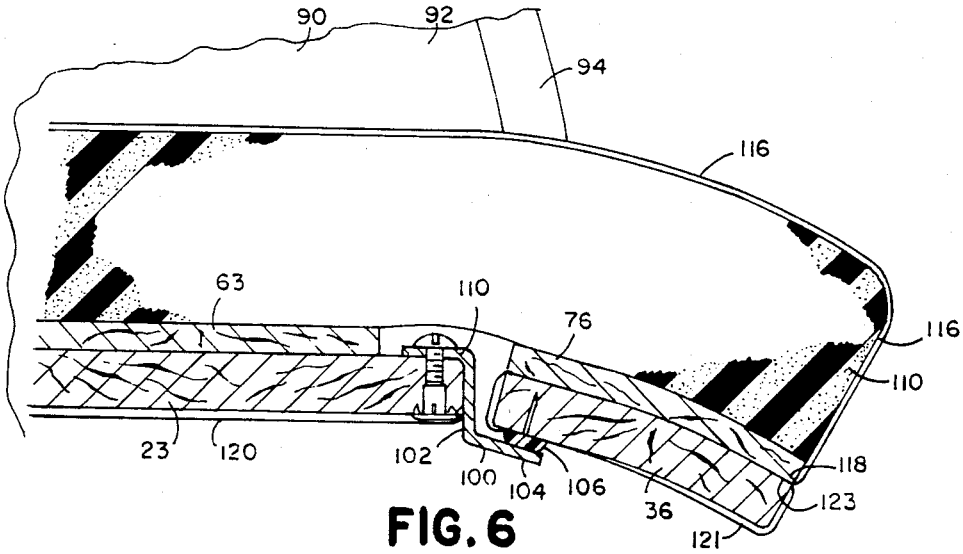
FIG. 6 is a fragmentary, side sectional, elevational view of the front flex portion of the chair of the present invention along line VI—VI of FIG. 5.
Figure 7:
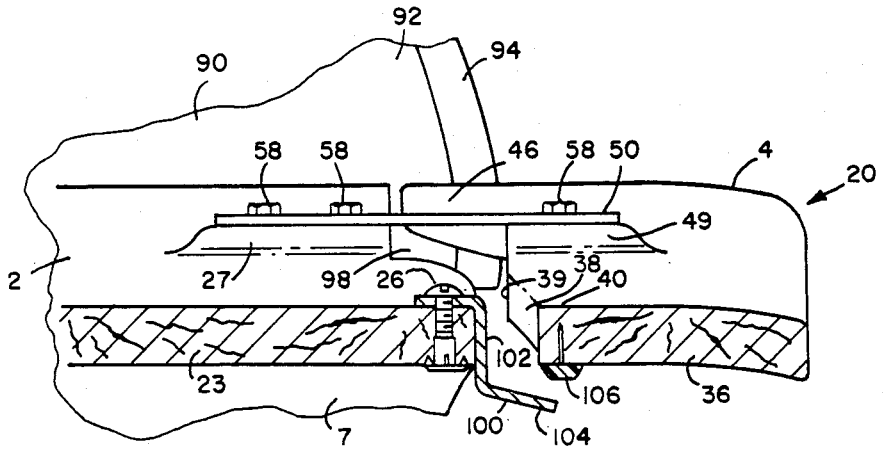
FIG. 7 is a fragmentary, side sectional view of the front flex portion of an outer chair shell along line VI—VI of FIG. 5, in an unflexed position.
Figure 8:
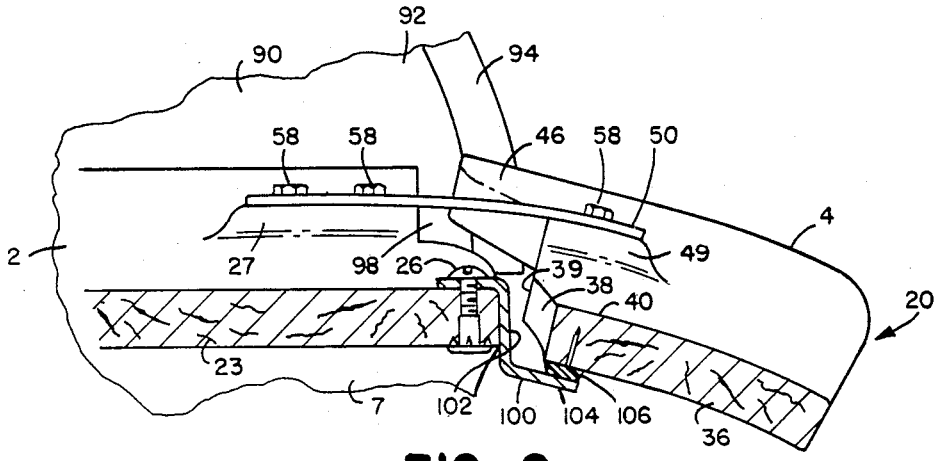
FIG. 8 is a fragmentary, side sectional view of the front flex portion of FIG. 7 in a flexed position.
Figure 9:
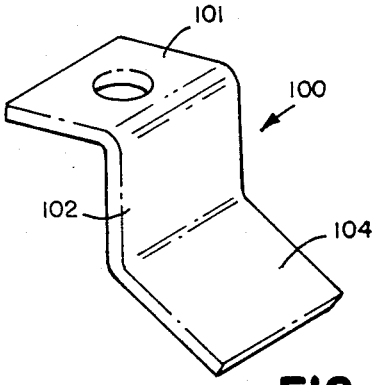
FIG. 9 is an oblique view of a stop bracket of the chair.

Leaf springs 50 include two apertures towards one end thereof and a third aperture toward the other end to facilitate receipt of mounting bolts (FIG. 5).

Figure 3:
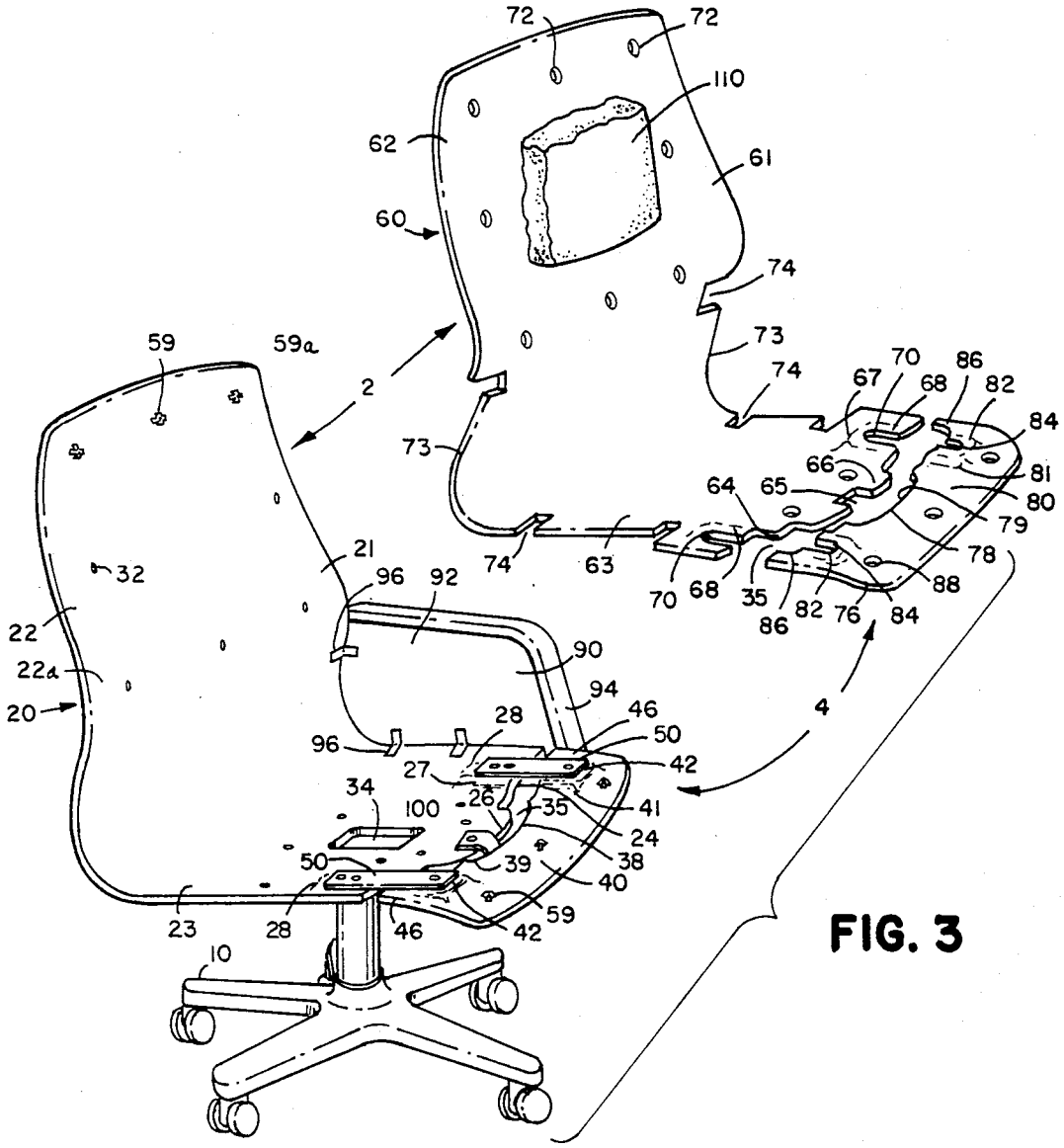
FIG. 3 is an exploded, oblique view of a chair inner and outer shell of the present invention.

Chair body 2 is conveniently made of outer shell 20 and inner shell 60. Outer shell 20 has a body 21 which includes back 22 and seat 23. As shown in FIG. 3, back 22 is of a high back design, though it need not be. Spaced throughout back 22 are apertures 32 for receiving fasteners 59 used to join inner shell 60 to outer shell 20. Seat 23 is generally concavely curved from side to side, the curved area extending all the way to front edge 24.

Figure 4:
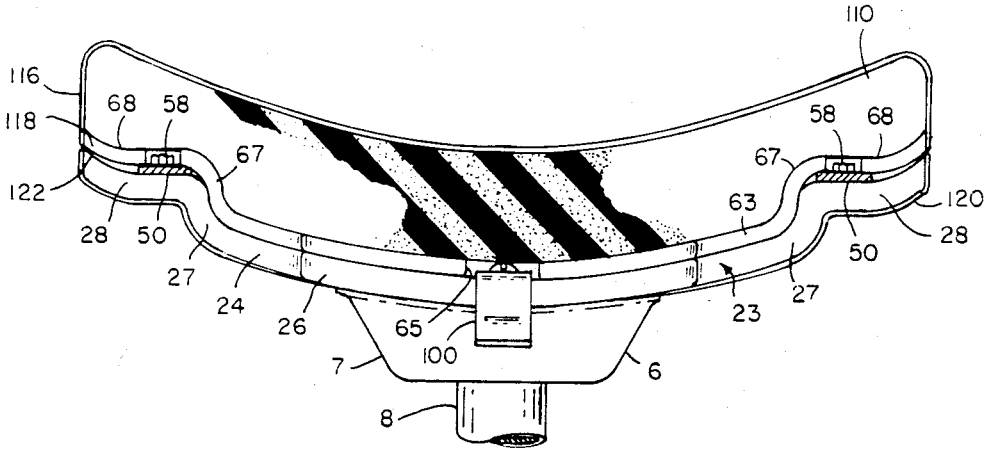
FIG. 4 is a fragmentary, front view of a chair seat portion taken along line IV—IV of FIG. 5, with the cushion in cross section.

Spaced on either side of the front of seat 23 are recurved portions 27 which provide a smooth transition to flattened platforms 28 (FIGS. 3 and 4) upon which leaf springs 50 are mounted. Platforms 28 are oriented so as to provide two level surfaces that lie generally in the same plane. This insures that leaf springs 50 will lie in generally the same plane and therefore flex properly together. If springs 50 were mounted on oppositely sloping curved surfaces, the ends of springs 50 would have to flex away from each other. Since thigh support 4 is connected to those ends, the result would be that thigh support 4 would not flex. In each platform 28 are two spaced apertures to facilitate mounting leaf springs 50. A tab 26 extends from front edge 24 only sufficiently far to cover a cowling 7 which covers chair control 6. Located behind tab 26 is aperture 34 which allows chair control 6 to operate without interference from seat 23. Cowling 7 (FIG. 4) covers tilt mechanism 6 and tab 26 is configured to correspond to the shape of the leading edge of cowling 7 so that cowling 7 does not extend beyond front edge 24.

Positioned in front of body 21 is the outer shell portion of thigh support 4, i.e., outer shell, thigh support 36. Thigh support 36 has a generally curved area 40 which corresponds to the curve of seat 23. Back edge 39 has an indented curve 38 that enhances clearance for and corresponds to extended tab 26. Spaced on either side of indented curve 38 are recurved areas 41 which provide a smooth transition from curved area 40 to flattened platforms 42. Platforms 42 are located so as to correspond to platforms 28, and also lie in a common plane. In each platform 42 is an aperture to facilitate mounting to the ends of leaf springs 50. On either side edge of thigh support 36 are extending end tabs 46 which extend back toward seat 23. Several apertures 48 are spaced about support 36 to facilitate securing an inner shell portion thereto with fasteners 59.

It is desirable that there be a fairly wide gap 35 (FIGS. 3 and 5) between seat body 23 and thigh support portion 36, at least in the areas where a person's legs would normally lie. It is found that, although front flex area 4 will function if gap 35 is reduced to abut seat 23 and thigh support 36, if a wide gap 35 is provided when the front flex area 4 is depressed, there is a smoothly curved transition between the seat and the flex area instead of a sharp lip or edge. Further, in accordance with this invention, some gap is maintained even when thigh support 4 is flexed down to its maximum extent. The leaf springs 50, because they do not compress, serve as means to maintain this comfort gap even throughout flexing. The gap between end tabs 46, 86 and seat 23, 63 are narrower in order to allow the gap to be masked from the side. Since a user does not normally sit on these outer edges of the chair, any sharp lip that is present at those points does not provide discomfort to the user.

Gap 35 is approximately 2 inches wide at the point of springs 50. This gap size is reduced somewhat between extended tab 26 and indented curve 38, but is reduced substantially at end tabs 46. End tabs 46 extend backward so as to reduce the gap at the sides of shell 20 to a width of approximately $\frac{1}{2}$ inch.

Leaf springs 50 connect body element 21 and thigh support 36. Leaf springs 50 are rectangular in shape, being substantially planar and having a longitudinal axis and a horizontal axis. Leaf springs 50 each have three apertures which are spaced to correspond to the apertures in the platforms 28 of seat 23 and the apertures in the platforms 42 of thigh support 36. Springs 50 are secured to outer shell 20 by bolts 58 through the apertures in platforms 28 and 42. When in an unflexed position, leaf springs 50 are located in the same plane and have parallel axes. Thus, as springs 50 are flexed, the ends of springs 50 connected to thigh support 36 do not separate, but remain equidistant in all positions.

Arms 90 are attached to body element 21, and include arm plates 92 to which are attached widened arm trim 94 (FIG. 3). Arm trim 94 provides a surface upon which a user's arms can rest comfortably. Arms 90 are attached to body 21 by means of L-shaped arm brackets 96 (FIG. 3). Arms 90 extend past front edge 24 of body 21 a distance greater than the width of gap 35 at end tabs 46. These extended portions 98 effectively block one's view of, and access to, gap 35 from the sides, whether front flex piece 4 is in the unflexed or flexed position. This prevents a user from accidentally inserting a hand or the like into the gap and sustaining injury, and also provides a finished appearance to seating unit 1 to give it an overall appealing design.

Stop 100 is connected to the center of extending tab 26 on outer shell 20 (FIGS. 3–8). Stop 100 is of steel and includes flange 101 which is bolted to tab 26 and a depending arm 102 which is bent at its free end into a stop plate 104. A resilient bumper is attached to the back edge 39 of outer thigh support 36 in a position so that as thigh support 36 is flexed downward, resilient bumper 106 will eventually contact stop plate 104.

Inner shell 60 includes body 61 and thigh support 76, which correspond to body 21 and thigh support 36 of outer shell 20. Body 61 has a back 62 and seat 63, back 62 being depicted in FIG. 3 as having a high back with lumbar support. As described for outer shell 20, back 62 can have a variety of configurations as desired.

Seat 63 is generally concavely curved to provide a comfortable surface for a user to sit upon, the curved area extending all the way to front edge (FIG. 3). Centered on front edge 64 is tab 66, which is of the configuration of extending tab 26 with the exception that centered on tab 66 is notch 65 which is sufficiently large to provide clearance for stop 100 which is mounted on tab 26. Along front edge 64 on either side of tab 66 are recurved surfaces 67 which provide a smooth transition from the curvature of seat 63 to platforms 68, which are located in the same horizontal plane. Platforms 68 are spaced above platforms 28 to provide clearance for springs 50 therebetween. Extending back into each platform 68 is a slot 70 of sufficient width and length to allow clearance for the tops of bolts 58 (FIG. 4) but not wide enough to allow clearance for the edges of leaf springs 50. Seat 63 is sufficiently thick that the heads of bolts 58 do not protrude above the upper level thereof. Such protrusion could create bumps in the cushioning.

Extending into each side of body 61 is an extended recess 73 in which arms 90 are located. Each recess 73 has notches 74 located so as to correspond to the positioning of, and to receive, arm brackets 96 on outer body 21. Distributed throughout body 61 are apertures 72, each aperture corresponding to an aperture 32 and fastener 59 carried on body 21.

Thigh support 76 has a generally concavely curved area 80 corresponding to the curve of body 61. Centered on the back edge 79 of thigh support 76 is indented curve 78 of a size and configuration to correspond to indented curve 38 on outer thigh support 36. Spaced on either side of indented curve 78 are recurved areas 81 which provide a smooth transition from curved area 80 to flattened platforms 82. Recurved areas 81 and flattened platforms 82 are such that flattened platforms 82 are raised from curved area 80 slightly more than flattened platforms 42 are raised from curved areas 40 of outer thigh support 36, to allow clearance for springs 50 therebetween. In each platform 82 are slots 84 of sufficient size as to allow clearance for bolts 58, but not so large as to allow springs 50 to pass therethrough, for reasons as described above. End tabs 86 extend backward toward seat 63 on either side edge of thigh support 76 to correspond to end tabs 46.

Inner shell 60 is secured to outer shell 20 by fasteners 59. Plastic snap fasteners 59 pass through apertures 32 and 72 and extend from outer shell 20. Fasteners 59 each have an expandable head 59*a*, which can be compressed as the inner shell 60 apertures pass over heads 59*a*, but which expand outward on the other side of inner shell 60. Inner body 61 is snapped onto outer body 21 by mating the protruding heads 59*a* of fasteners 59 with apertures 72. Likewise, inner thigh support 76 is snapped onto outer thigh support 36 by means of fasteners 59. Bolts 58 extend upward into slots 70 and 84, while brackets 96 extend up into notches 74. Flange 101 of stop 100 extends into notch 65. Inner shell 60 and outer shell 20 fit snuggly together since they have the same configuration, with the exception that the flattened platforms 68 and 82 on inner shell 60 contact the upper surface of leaf springs 50, and therefore are raised slightly above the surface of flattened platforms 28 and 42 of outer shell 20.

A unitary foam cushion 110 is glued to the upper surface of inner shell 60. Foam cushion 110 covers back 62, seat 63, thigh support 76 and bridges gap 35 between seat 63 and thigh support 76. Inner upholstery fabric 116 covers the entire foam pad 110 and is tucked under inner shell 60 to form a lip 118 which is either glued or stapled to inner shell 60. Outer upholstery fabric 120 covers the entire lower surface of outer body element 21 and is folded over the top of body element 21 to form a lip 122 which is glued or stapled thereto. Another outer upholstery fabric piece 121 covers the entire outer surface of outer thigh support 36 and is folded over to form a lip 123 which is stapled or glued thereto. Lips 118, 122 and 123 are therefore pressed between outer shell 20 and inner shell 60 when the two shells are snapped together, thereby hiding the ends of the upholstery fabric.

Although the seat area is concavely curved so as to provide comfortable support for a user, the flattened platforms 28 and 42 maintain springs 50 in the same horizontal plane with each other so that the ends of springs 50 remain equidistant, even while being flexed. If springs 50 were mounted on a curved surface the ends of springs 50 would be required to separate in order to flex and therefore flex area 4 would be immobile.

Due to the configuration of gap 36 is defined between chair area 2 and the front flex area 4, the front flex area 4 does not interfere with cowling 7 when the flex area 4 is depressed. Since springs 50 are connected to body 21 at two discrete points, springs 50 cannot pivot about their connecting point and thereby shift flex area 4 from side to side.

In manufacture, outer body 21 and outer thigh support 36 are made of molded laminate plywood ½ inch thick, and inner body 61 and inner thigh support 76 are made of molded laminate plywood 3/16 inch thick. Outer body 21 and outer thigh support 36 are upholstered, and support post 8 and tilt control 6 are secured to body 21. Glue is applied to the upper surface of inner body 61 and a foam cushion 110 of the proper configuration is pressed thereto so as to extend out past front edge 64. Glue is then applied to inner thigh support 76, which is then pressed onto the foam cushion 110 at the proper location so as to define the desired gap 35 between seat 63 and thigh support 76. Inner shell 60 with cushion 110 is then upholstered as described previously. Inner shell 60 is fitted between arms 90 and snapped onto outer shell 20 by means of fasteners 59.

It is to be understood that the above is only a description of the preferred embodiment and various changes or modifications can be made without departing from the spirit of the concept disclosed; such as a different style of seat back or support post, the removal of the arms, or replacement of the arms with an extended side seat element to mask the flexing gap. The scope of the invention is defined by the claims which follow given the breadth of interpretation that the law allows.

The embodiments of the invention in which an exclusive property or privilege is claimed are defined as follows:

1. A seating unit comprising:

a seat element for supporting a user;

a thigh support disposed in front of said seat element so as to contact at least a portion of the thigh area of a user; and leaf spring means flexibly resiliently connecting said seat element and said thigh support, such that said thigh support will be deflected downward under the weight of a user's legs, said leaf spring means being sufficiently stiff to provide at least some support for the weight of a user's legs when the user is seated in the seating unit, said leaf spring means providing the sole substantial support for said thigh support through the range of deflection of said thigh support.

2. A seating unit as defined in claim 1 wherein said thigh support is spaced from said seat element so as to define a gap therebetween.

3. A seating unit as defined in claim 2 wherein said leaf spring means comprises first and second spaced leaf springs being disposed in same plane with their longitudinal axes oriented parallel to each other.

4. A seating unit as defined in claim 1 wherein said leaf spring means comprises first and second spaced leaf springs being disposed in same plane with their longitudinal axes oriented parallel to each other.

5. A seating unit comprising:

a seat element for supporting a user;

a thigh support disposed in front of said seat element so as to contact at least a portion of the thigh area of a user;

leaf spring means flexibly resiliently connecting said seat element and said thigh support, such that said thigh support will be deflected downward under the weight of a user's legs, said leaf spring means being sufficiently stiff to provide at least some support for the weight of a user's legs when the user is seated in the seating unit;

said thigh support being spaced from said seat element so as to define a gap therebetween; and said thigh support having rearwardly extending tabs disposed on the sides of said thigh support and extending back towards said seat to at least partially mask said gap at each side of said seating unit.

6. A seating unit as defined in claim 5 further comprising stop means for limiting the maximum deflection of said thigh support.

7. A seating unit as defined in claim 6 wherein said leaf spring means comprises first and second spaced leaf springs being disposed in said plane with their longitudinal axes oriented parallel to each other.

8. A seating unit of any of claims 1 through 7 in which said seat element is tiltably mounted on a supporting base whereby a user can tilt back in said seating unit.

9. A seating unit as defined in claim 8 further comprising cushion means for cushioning said seat element, said cushioning means supported by said seat element and said thigh support and bridging said gap between said seat element and said thigh support.

10. A seating unit comprising:

a seat element for supporting a user;

a thigh support disposed in front of said seat element so as to contact the thigh area of a user;

leaf spring means connecting said seat element and said thigh support so as to define a gap between said seat element and said thigh support;

said leaf spring means being flexible and resilient so that said thigh support will be deflected downward under the weight of a user's legs, said leaf spring means being sufficiently stiff to provide at least some support for the weight of a user's legs, said leaf spring means providing the sole substantial support for said thigh support through the range of deflection of said thigh support; and masking means for covering said gap at the sides of said seat element and said thigh support.

11. A seating unit as defined in claim 10 wherein said masking means includes arms disposed adjacent the sides of said seat element and extending past the end of said seat element so as to cover said gap from the sides.

12. A seating unit comprisng:

a seat element for supporting a user;

a thigh support disposed in front of said seat element so as to contact the thigh area of a user;

leaf spring means connecting said seat element and said thigh support so as to define a gap between said seat element and said thigh support;

said leaf spring means being flexible and resilient so that said thigh support will be deflected downward under the weight of a user's legs, said leaf spring means being sufficiently stiff to provide at least some support for the weight of a user's legs; and masking means for covering said gap at the sides of said seat element and said thigh support, said masking means including rearwardly extending tabs on the edges of said thigh support extending rearwardly towards said seat element to reduce said gap, and arms located adjacent said seat element and extending past the front of said seat element and past the rearward extremity of said rearwardly extending tabs to mask said gap from the sides of said seating unit.

13. A seating unit as defined in claim 12 wherein said leaf spring means comprises first and second spaced leaf springs being disposed in same plane with their longitudinal axes oriented parallel to each other.

14. A seating unit as described in claim 13 further comprising a stop means mounted on said seat for engaging said thigh support as it is flexed downwardly for limiting the maximum amount of deflection of said thigh support.

15. A seating unit comprising:

a seat element for supporting a user;

a thigh support disposed in front of said seat element so as to contact the thigh area of a user;

leaf spring means connecting said seat element and said thigh support so as to define a gap between said seat element and said thigh support;

said leaf spring means being flexible and resilient so that said thigh support will be deflected downward under the weight of a user's legs, said leaf spring means being sufficiently stiff to provide at least some support for the weight of a user's legs;

masking means for covering said gap at the side of said seat element and said thigh support;

a chair tilt mechanism cowling abutting said seat element; and said seat element having an extending tab protruding into said gap and said cowling abutting said extending tab, said thigh support defining an indented curved edge complementary to said extending tab so as to substantially maintain said gap width and allowing said thigh support to be deflected without interference from said cowling.

16. A seating unit as defined in claim 14, 15, or 11 further comprising cushion means for cushioning said seat element, said cushioning means supported by said seat element and said thigh support and bridging said gap between said seat element and said thigh support.

17. A seating unit comprising:

a seat element for supporting a user;

a thigh support disposed in front of said seat element so as to contact the thigh area of a user;

at least two flexible, resilient leaf springs, extending between and connecting said seat element and said thigh support, said leaf springs disposed generally within the same plane and oriented generally parallel to each other so that said thigh support will be deflected downward under the weight of a user's legs;

stop means for limiting the maximum amount of deflection of said thigh support; and said leaf springs and said stop means providing the sole substantial support for said thigh support.

18. A seating unit as described in claim 17 wherein said stop means comprises a bracket secured to one of either said seat element or said thigh support and located so as to contact the other of said seat element or said thigh support at the point of maximum deflection of said thigh support.

19. A seating unit as described in claim 18 wherein said bracket is carried on said seat element and contacts a resilient element on said thigh support.

20. A seating unit comprising:

a generally concavely curved seat element having at least two first spaced generally flat areas disposed within the same plane and towards opposite sides of said seat element, said seat element including a first concavely curved zone between said first flat areas;

a front thigh support having an overall concavely curved configuration, and having at least two second spaced, generally flat areas disposed generally within the same plane and spaced towards opposite sides of said thigh support to correspond in location to said first areas, said thigh support including a second concavely curved zone between said second flat areas; and leaf springs connecting said seat element and said thigh support, said leaf springs being supported on said first and second generally flat areas such that said front thigh support deflects downwardly under the pressure of the legs of a user, said leaf springs being sufficiently stiff to provide at least some support for the weight of the legs of a user when the user is seated in the seating unit.

21. A seating unit as defined in claim 20 further comprising stop means for limiting the maximum amount of deflection of said front flex element.

22. A seating unit as defined in claim 20 wherein said thigh support is spaced from said seat element so as to define a gap therebetween.

23. A seating unit as defined in claim 22 further comprising stop means for limiting the maximum amount of deflection of said front flex element.

24. A seating unit comprising:

a generally concavely curved seat element having at least two first spaced generally flat areas disposed within the same plane and towards opposite sides of said seat element;

a front thigh support having an overall concavely curved configuration, and having at least two second spaced, generally flat areas disposed generally within the same plane and spaced towards opposite sides of said thigh support to correspond in location to said first areas;

leaf springs connecting said seat element and said thigh support, said leaf springs being supported on said first and second generally flat areas such that said front thigh support deflects downwardly under the pressure of the legs of a user, said leaf springs being sufficiently stiff to provide at least some support for the weight of the legs of a user when the user is seated in the seating unit;

said thigh support being spaced from said seat element so as to define a gap therebetween; and said thigh support having rearwardly extending tabs disposed on the sides of said thigh support and extending back towards said seat to at least partially mask said gap at each side of said seating unit.

25. A seating unit comprising:

a generally concavely curved seat element having at least two first spaced generally flat areas disposed within the same plane and towards opposite sides of said seat element;

a front thigh support having an overall concavely curved configuration, and having at least two second spaced, generally flat areas disposed generally within the same plane and spaced towards opposite sides of said thigh support to correspond in location to said first areas;

leaf springs connecting said seat element and said thigh support, said thigh support being spaced from said seat element so as to define a gap therebetween, said thigh support having rearwardly extending tabs disposed on the sides of said thigh support and extending back towards said seat to at least partially mask said gap at each side of said seating unit, said leaf springs being supported on said first and second generally flat areas such that said front thigh support deflects downwardly under the pressure of the legs of a user, said leaf springs being sufficiently stiff to provide at least some support for the weight of the legs of a user when the user is seated in the seating unit;

a chair tilt mechanism cowling abutting said seat element; and said seat element having an extending tab protruding into said gap and said cowling abutting said extending tab, said thigh support defining an indented curved edge complementary to said extending tab so as to substantially maintain said gap width and allowing said thigh support to be deflected without interference from said cowling.

26. A seating unit as defined in claim 25 further comprising stop means for limiting the maximum amount of deflection of said front flex element.

27. A seating unit of any of claims 20 through 26 in which said seat element is tiltably mounted on a supporting base whereby a user can tilt back in said seating unit.

28. A seating unit as defined in claim 27 further comprising cushion means for cushioning said seat element, said cushioning means supported by said seat element and said thigh support and bridging said gap between said seat element and said thigh support.

29. A seating unit comprising:

a seat element for supporting a user;

a thigh support disposed in front of said seat element so as to contact at least a portion of the thigh area of a user;

connecting means for connecting said seat element and said thigh support element, so as to define a gap between said seat element and said thigh support;

flex means for allowing said thigh support to flex downwardly under the weight of a user's legs when the user is seated in the seating unit;

separation means for maintaining some gap between said seat element and said thigh support when said thigh support is flexed downward to a fully downwardly flexed position in order to allow a smooth transition between said seat element and said thigh support in a cushion supported by the seating unit, said connecting means comprising said separation means; and masking means for covering said gap at the sides of said seat element and said thigh support, said masking means including arms located adjacent said seat element and extending past the front of said seat element, said masking means including rearwardly extending tabs on the edges of said thigh support extending rearwardly towards said seat element to reduce said gap, and said arms extending past the rearward extremity of said rearwardly extending tabs to mask said gap from the sides of said seating unit.

30. A seating unit as defined in claim 29 further comprising cushion means for cushioning said seat element, said cushioning means supported by said seat element and said thigh support and bridging said gap between said seat element and said thigh support.

31. A seating unit comprising:

a seat element for supporting a user;

a thigh support disposed in front of said seat element so as to contact at least a portion of the thigh area of a user;

connecting means for connecting said seat element and said thigh support element, so as to define a gap between said seat element and said thigh support;

flex means for allowing said thigh support to flex downward under the weight of a user's legs when the user is seated in the seating unit;

separation means for maintaining some open gap between said seat element and said thigh support when said thigh support is flexed downward to a fully downwardly flexed position in order to allow a smooth transition between said seat element and said thigh support in a cushion supported by the seating unit, said connecting means comprising said separation means;

masking means for covering said gap at the sides of said seat element and said thigh support; and said masking means includes rearwardly extending tabs on the edges of said thigh support extending rearwardly towards said seat element to reduce said gap and arms located adjacent said seat element and extending past the front of said seat element, said arms extending past the rearward extremity of said rearwardly extending tabs to mask said gap from the sides of said seating unit.

32. A seating unit as defined in claim 28 further comprising cushion means for cushioning said seat element, said cushioning means supported by said seat element and said thigh support and bridging said gap between said seat element and said thigh support.

33. A seating unit comprising:

a generally concavely curved seat element having at least two first spaced, generally flat areas disposed within the same plane and towards opposite sides of said seat element, said seat element having a first concavely curved zone between said first flat areas;

a front thigh support having an overall concavely curved configuration, having at least two second spaced, generally flat areas disposed generally within the same plane and spaced towards opposite sides of said thigh support to correspond in location to said first flat areas, said thigh support having a second concavely curved zone between said second flat areas;

connecting means connecting said seat element and said thigh support;

flex means for allowing said thigh support to flex downward under the weight of a user's legs when the user is seated in the seating unit; and said spaced connecting means being mounted at one end on said first seat areas and at the other end on said second flat areas rather than on concavely curved portions of said seat element and thigh support, whereby said end and said other end of said connecting means remain equidistant as said thigh support flexes downwardly.

34. A seating unit as described in claim 33 wherein said connecting means comprises said flex means.

35. A seating element as described in claim 34 wherein said seat element and said thigh support define a gap therebetween.

36. A seating unit as defined in claim 35 further comprising masking means for covering said gap at the sides of said seat element and said thigh support.

37. A seating unit as defined in claim 35 further comprising cushion means for cushioning said seat element said cushioning means supported by said seat element and said thigh support and bridging said gap between said seat element and said thigh support.

38. A seating unit as defined in claim 34 further comprising cushion means for cushioning said seat element, said cushioning means supported by said seat element and said thigh support and bridging said gap between said seat element and said thigh support.

39. The seating unit of claim 33 wherein said connecting and flex means comprise spaced leaf springs mounted on said first and second flat areas.

40. A seat unit comprising:

a seat element for supporting a user;

a thigh support disposed in front of said seat element so as to contact at least a portion of the thigh area of a user; and spring means flexibly resiliently connecting said seat element and said thigh support, such that said thigh support will be deflected downward under the weight of a user's legs, said spring means being sufficiently stiff to provide at least some support for the weight of a user's legs when the user is seated in the seating unit, said spring means providing the sole substantial support for said thigh support through the range of deflection of said thigh support.

41. A seating unit as defined in claim 40 wherein said thigh support is spaced from said seat element so as to define a gap therebetween.

42. A seat unit comprising:

a seat element for supporting a user;

a thigh support disposed in front of said seat element so as to contact at least a portion of the thigh areas of a user;

spring means flexibly resiliently connecting said seat element and said thigh support, such that said thigh support will be deflected downward under the weight of a user's legs, said spring means being sufficiently stiff to provide at least some support for the weight of a user's legs when the user is seated in the seating unit, and;

said thigh support being spaced from said seat element so as to define a gap therebetween, said thigh support having rearwardly extending tabs disposed on the sides of said thigh support and extending back towards said seat to at least partially mask said gap at each side of said seating unit.

43. A seating unit as defined in claim 42 further comprising cushion means for cushioning said seat element, said cushioning means supported by said seat element and said thigh support and bridging said gap between said seat element and said thigh support.

44. A seating unit of any of claims 40 through 43 further comprising stop means for limiting the maximum deflection of said thigh support.

* * * * *

UNITED STATES PATENT AND TRADEMARK OFFICE

CERTIFICATE OF CORRECTION

PATENT NO. : 4,498,702

DATED : February 12, 1985

INVENTOR(S) : William Barret Raftery

It is certified that error appears in the above-identified patent and that said Letters Patent is hereby corrected as shown below:

Column 4, line 59:
after "edge" insert --64--

Column 6, line 9:
"36 is defined" should be --35 defined--

Column 7, claim 7, line 26:
"said" should be --same--

Column 7, claim 12, line 57:
"comprisng" should be --comprising--

Column 12,claim 42, line 45:
"areas" should be --area--

Signed and Sealed this

*Twenty-seventh* Day of *August 1985*

[SEAL]

*Attest:*

DONALD J. QUIGG

*Attesting Officer* *Acting Commissioner of Patents and Trademarks*